US008258087B2

(12) United States Patent
Yaguchi

(10) Patent No.: US 8,258,087 B2
(45) Date of Patent: Sep. 4, 2012

(54) LUBRICATING OIL COMPOSITION FOR INTERNAL COMBUSTION ENGINE

(75) Inventor: Akira Yaguchi, Kanagawa (JP)

(73) Assignee: Nippon Oil Corporation, Tokyo (JP)

( * ) Notice: Subject to any disclaimer, the term of this patent is extended or adjusted under 35 U.S.C. 154(b) by 133 days.

(21) Appl. No.: 12/517,093

(22) PCT Filed: Dec. 5, 2007

(86) PCT No.: PCT/JP2007/073511

§ 371 (c)(1),
(2), (4) Date: Sep. 14, 2009

(87) PCT Pub. No.: WO2008/072526

PCT Pub. Date: Jun. 19, 2008

(65) Prior Publication Data

US 2010/0075875 A1 Mar. 25, 2010

(30) Foreign Application Priority Data

Dec. 8, 2006 (JP) ..... 2006-331828
Dec. 8, 2006 (JP) ..... 2006-331831

(51) Int. Cl.
*C10G 71/00* (2006.01)
*C10L 1/22* (2006.01)
*C10M 133/56* (2006.01)

(52) U.S. Cl. ..... 508/192; 508/228; 508/291; 208/19

(58) Field of Classification Search ..... 508/19, 508/192, 228, 291; 208/19
See application file for complete search history.

(56) References Cited

U.S. PATENT DOCUMENTS

2002/0058593 A1* 5/2002 Bovington et al. ..... 508/192
2004/0192562 A1* 9/2004 Morita ..... 508/185
2005/0133408 A1* 6/2005 Abernathy et al. ..... 208/19

FOREIGN PATENT DOCUMENTS

| | | | |
|---|---|---|---|
| EP | 1 437 396 | A1 | 7/2004 |
| EP | 1 535 985 | A1 | 6/2005 |
| JP | 2002-294271 | A | 10/2002 |
| JP | 2003-528169 | A | 9/2003 |
| JP | 2003-277782 | A | 10/2003 |
| WO | 2005/090532 | A1 | 9/2005 |
| WO | 2006/073198 | A1 | 7/2006 |
| WO | 2007/114132 | A1 | 10/2007 |

OTHER PUBLICATIONS

International Search Report: PCT/JP2007/073511.
European Search Report; mailed Sep. 27, 2011; Appln. EP 07 85 0135.

* cited by examiner

*Primary Examiner* — Walter D Griffin
*Assistant Examiner* — Francis C Campanell
(74) *Attorney, Agent, or Firm* — Ladas & Parry LLP

(57) ABSTRACT

A lubricating oil composition for an internal combustion engine. The lubricating oil composition includes: (A1) a lubricant base oil as a main component having a kinematic viscosity at 100 degree C. being 1 to 8 $mm^2/s$, pour point being −15 degree C. or less, aniline point being 100 degree C. or more, paraffinic content in saturates being 40 mass % or more, monocyclic naphthenic content being 25 mass % or less, bicyclic to hexacyclic naphthenic content being 35 mass % or less, iodine number being 2 or less, and ratio of tertiary carbon to the total carbon atoms composing the (A1) being 6.3% or more. The total mass of the composition is: (B) 0.005 to 0.5 mass % of a metallic detergent as metal content; (C1) 0.005 to 0.2 mass % of a boron-containing succinimide ash-less dispersant as boron content; and (D) 0.005 to 0.2 mass % of a metal salt of phosphorus-containing acid as phosphorus content.

21 Claims, No Drawings

LUBRICATING OIL COMPOSITION FOR INTERNAL COMBUSTION ENGINE

TECHNICAL FIELD

The present invention relates to a lubricating oil composition for internal combustion engine; more particularly, it relates to a lubricating oil composition for internal combustion engine which exhibits excellent high-temperature detergency, but also exhibits excellent base number retention even under a condition where moisture is mixed and accumulated, and which enables to make the metallic detergent effectively function for a long time. Moreover, the invention relates to a lubricating oil composition which can be suitably used for an internal combustion engine of a hybrid vehicle having both of an electric motor and an engine, which is driven by either one or both of them.

BACKGROUND ART

In recent years, a hybrid vehicle, which carries both of an electric motor and an engine and which is driven by either one or both of them, has been developed for practical use. Typical examples of hybrid vehicle include: a "series system" whose engine is used as a power source of an electric power generator and is only driven by a motor; a "parallel system" whose driving is mainly done by a motor at low speed and mainly done by an engine at high speed, wherein the motor drive assists the engine drive at start-up as well as at sudden acceleration; and a "series-parallel system" which is mainly driven by motor at both start-up and low speed, while distributing the engine drive and the motor at higher speed in a well-balanced manner. About these hybrid vehicles, engine is shut down during stoppage time; while when traveling only by motor drive or braking, operations such as controlling fuel system of the engine are carried out. Because of this, stoppage and operation of the engine are repeated. Consequently, it can be said that the engine oil used for these vehicles faces a specific usage environment compared with that of engine oil for conventional vehicle driven only by engine. However, such a lubricating oil for internal combustion engine specializing for hybrid vehicles has not been sufficiently studied; thereby, in fact, discovery thereof has been hardly obtained.

The present inventors had studied about characteristics of the lubricating oil suitably used for internal combustion engine of the above hybrid vehicles. As a result, when used in the hybrid vehicles, function of the metallic detergent tends to be deteriorated in a shorter time than that used in a conventional internal combustion engine; for the purpose of retention of engine performance and life extension of the lubricating oil, it is found out that high-temperature detergency of the new oil should be largely raised from the conventional level and the performance should be retained. When studied more specifically, about use conditions of the internal combustion engine for hybrid vehicles, particularly parallel system or series-parallel system hybrid vehicles, it is found that moisture mixed in the lubricating oil tends to be accumulated, due to the deterioration of the metallic detergent by hydrolysis, calcium carbonate tends to be agglomerated and base number of the lubricating oil also tends to be significantly decreased. Therefore, as a lubricating oil suitable for the internal combustion engine of the above described hybrid vehicle, an oil which essentially exhibits excellent hydrolytic stability and high performance of base number retention; further, for the purpose of retention of engine performance and life extension of the lubricating oil, the lubricating oil is required to have high-temperature detergency when being new oil, whose performance can be retained.

Normally, to the lubricating oil for internal combustion engine, zinc dithiophosphate is added as a combination of anti-wear agent and antioxidant; moreover, in order to enhance oxidation stability, high-temperature detergency, and acid-neutralizing ability, various additives such as overbased metallic detergent and ashless dispersant are blended. So as to minimize the impact on an exhaust emission control system and the like as much as possible, low-phosphorus and low-ash lubricating oil for internal combustion engine has been studied. Nevertheless, if the overbased metallic detergent is simply reduced for lowering ash content, high-temperature detergency and acid-neutralizing ability becomes insufficient. Hence, it is important to make the metallic detergent effectively function within the limited content and to retain the high-temperature detergency and acid-neutralizing ability at a high level for a long time. However, when low-ash oil in which zinc dithiophosphate is mainly contained is used, raising the level of high-temperature detergency is difficult. Especially, like the internal combustion engine of the hybrid vehicle, under the condition where moisture tends to be mixed and accumulated, it is quite difficult to make the overbased metallic detergent effectively function for a long time.

Recently, as a lubricating oil composition which shows excellent high-temperature detergency and long-drain performance of base number retention and so on, a sulfur-free lubricating oil (e.g. dialkyl zinc phosphate) and a lubricating oil containing sulfur-reduced phosphorus compound are proposed (for example, Patent Documents 1 and 2).

Patent Document 1: Japanese Patent Application Laid-open (JP-A) No. 2002-294271

Patent Document 2: Japanese Patent No. 3662228

DISCLOSURE OF THE INVENTION

Problems to be solved by the Invention

The lubricating oils described in the Patent Documents 1 and 2 are low-sulfur compositions showing favorable high-temperature detergency and base number retention so that these can be suitably used for mainly gas engine application. Whereas, when zinc dithiophosphate is used as a main component, when metallic detergent of higher metal ratio is used, or when content of metallic detergent is reduced, favorable high-temperature detergency and base number retention are required. Considering the use conditions, particularly, in the internal combustion engine of hybrid vehicles where moisture is mixed and accumulated, retention of lowering high-temperature detergency and base number at higher level is required.

Accordingly, the first object of the present invention is to provide a lubricating oil composition for internal combustion engine which is excellent in high-temperature detergency so that it is capable of retaining engine performance and extending the lifetime of the lubricating oil.

The second object of the invention is to provide a lubricating oil composition for internal combustion engine, which is not only excellent in high-temperature detergency but also favorable in hydrolytic stability; in other words, the object of the invention is to provide a lubricating oil composition for internal combustion engine which is excellent in base number retention performance even under the conditions particularly where moisture can be mixed and accumulated.

The third object of the invention is to provide a lubricating oil composition for internal combustion engine, which is suitably used for an internal combustion engine of a hybrid vehicle driven by electric motor and/or engine, particularly an internal combustion engine of a parallel system hybrid vehicle or series-parallel system hybrid vehicle where stoppage and operation of the engine are repeated and which is excellent in high-temperature detergency as well as hydrolytic stability.

Means for Solving the Problems

The present inventors had been seriously studied to solve the above-described problems. As a result, they discovered that the lubricating oil composition for internal combustion engine containing certain lubricant base oil and additives is excellent in high-temperature detergency. Moreover, the inventors discovered that by selecting the certain lubricant base oil and additives, then combining thereof, the lubricating oil composition for internal combustion engine becomes significantly excellent in high-temperature detergency and excellent in hydrolytic stability. Thus, they found that the lubricating oil composition can be suitably used for internal combustion engine of a hybrid vehicle; hence, the following invention was completed.

The first aspect of the present invention is a lubricating oil composition for internal combustion engine, which includes: (A1) a lubricant base oil as a main component characterized by kinematic viscosity at 100 degree C. being 1 to 8 $mm^2/s$, pour point being −15 degree C. or less, aniline point being 100 degree C. or more, paraffinic content in saturates being 40 mass % or more, monocyclic naphthenic content being 25 mass % or less, bicyclic to hexacyclic naphthenic content being 35 mass % or less, iodine number being 2 or less, and ratio of tertiary carbon to the total carbon atoms composing the (A1) being 6.3% or more; and which further includes, to the total mass of the composition: (B) 0.005 to 0.5 mass % of a metallic detergent as metal content; (C1) 0.005 to 0.2 mass % of a boron-containing succinimide ashless dispersant as boron content; and (D) 0.005 to 0.2 mass % of a metal salt of phosphorus-containing acid as phosphorus content.

In the first aspect of the invention, the (A1) component preferably contains a base oil manufactured by a process including catalytic dewaxing process.

In the first aspect of the invention, ratio of tertiary carbon to the total carbon atoms composing the (A1) component is preferably 7.2% or more.

In the first aspect of the invention, iodine number of the (A1) component is preferably 0.5 or less.

In the first aspect of the invention, the (B) component is preferably a metal salt and/or basic (overbased) salt of alkylsalicylic acid containing (B1) a dialkylsalicylic acid. In this description, "basic (overbased)" means a basic salt or overbased salt.

In the first aspect of the invention, content of the (C1) component to the total mass of the composition is preferably 0.005 to 0.03 mass % as boron content.

The lubricating oil composition for internal combustion engine of the first aspect of the present invention preferably further includes 0.005 to 0.2 mass % of (C2) a boron-free succinimide ashless dispersant as nitrogen content, wherein mass ratio (B/N ratio) of boron content attributed to the (C1) component to a total nitrogen content attributed to the (C1) component and the (C2) component is preferably 0.05 to 0.3.

The lubricating oil composition of the first aspect of the invention can be used for internal combustion engine of a hybrid vehicle.

The second aspect of the present invention is a lubricating oil composition for internal combustion engine of hybrid vehicle, which includes: (A) a lubricant base oil, and which further includes, to the total mass of the composition: (B') 0.005 to 0.5 mass % of a salicylate detergent as metal content; (C2) 0.005 to 0.4 mass % of a boron-free succinimide ashless dispersant as nitrogen content; and (D) 0.005 to 0.2 mass % of a metal salt of phosphorus-containing acid as phosphorus content.

The third aspect of the present invention is a lubricating oil composition for internal combustion engine of hybrid vehicle, which includes: (A) a lubricant base oil, and which further includes, to the total mass of the composition: (B') 0.005 to 0.5 mass % of a salicylate detergent as metal content; (C1) 0.001 to 0.03 mass % of a boron-containing succinimide ashless dispersant as boron content; (C2) 0.005 to 0.4 mass % of a boron-free succinimide ashless dispersant as nitrogen content; and (D) 0.005 to 0.2 mass % of a metal salt of phosphorus-containing organic acid as phosphorus content.

In the third aspect of the invention, mass ratio (B/N ratio) of boron content attributed to the (C1) component to a total nitrogen content attributed to the (C1) component and the (C2) component is preferably 0.05 to 0.3.

In the second and third aspects of the invention, the (B') component is preferably a metal salt and/or basic (overbased) salt of alkylsalicylic acid containing (B1) a dialkylsalicylic acid.

Effects of the Invention

The lubricating oil composition for internal combustion engine of the present invention is extremely excellent in high-temperature detergency so that retention of engine performance and life extension of the lubricating oil can be attained. The lubricating oil composition for internal combustion engine of the invention also exhibits favorable hydrolytic stability; thereby even under the condition where moisture tends to be mixed and accumulated, it is capable of retaining base number in favorable manner. Therefore, the lubricating oil composition can be suitably used for an internal combustion engine of particularly hybrid vehicles driven by electric motor and/or engine, among them, hybrid vehicles employing parallel system or series-parallel system in which stop and operation of the engine are frequently repeated. In addition, it can be suitably used for internal combustion engine for marine vessel such as outboard motor and the like operated under a condition where moisture is hard to evaporate, gas engine to which a large amount of moisture tends to be mixed, or gasoline engine and diesel engine which controls idling stop may be preferably used.

BEST MODE FOR CARRYING OUT THE INVENTION

Hereinafter, the lubricating oil composition of the present invention will be more specifically described.

<(A) Component, (A1) Component>

(A) Component in the lubricating oil composition of the present invention is a lubricant base oil; mineral base oil and/or synthetic base oil used for conventional lubricating oil can be used.

As the mineral base oil, for example, there may be: a material by refining a lubricating oil fraction, which is obtained by vacuum distillation of topped crude obtained by topping of crude oil, by using one or more treatment such as solvent deasphalting, solvent extraction, hydrocracking, hydroisomerization, solvent dewaxing, catalytic dewaxing, hydrorefining, and etc.; or a mineral base oil which is produced by isomerizing wax and/or GLT WAX (gas-to-liquid wax).

Specific examples of synthetic base oil include: polybutene or the hydrogenated product thereof; poly-α-olefin such as 1-octene oligomer and 1-decene oligomer, or the hydrogenated product thereof; diester such as ditridecyl glutalate, di-2-ethylhexyl adipate, diisodecyl adipate, ditridecyl adipate, and di-2-ethylhexyl sebacate; polyol ester such as neopentyl glycol ester, trimethylolpropane caprylate, trimethylolpropane pelargonate, pentaerythritol-2-ethyl hexanoate, and pentaerythritol pelargonate; aromatic synthetic oil such as alkyl naphthalene, alkyl benzene, and aromatic ester; or mixture thereof.

As the (A) lubricant base oil in the invention, the above mineral base oil, the above synthetic base oil, or a mixture of two or more selected from the above group can be used. For instance, there may be: one or more mineral base oil, one or more synthetic base oil, as well as a mixture of one or more mineral base oil and one or more synthetic base oil.

In the lubricating oil composition of the invention, as the (A) component, the following lubricant base oil (A1) can be more preferably used.

(A1) Component in the lubricating oil composition of the invention is "a lubricant base oil characterized by kinematic viscosity at 100 degree C. being 1 to 8 $mm^2/s$, pour point being −15 degree C. or less, aniline point being 100 degree C. or more, paraffinic content in the saturates being 40 mass % or more, monocyclic naphthenic content being 25 mass % or less, bicyclic to hexacyclic naphthenic content being 35 mass % or less, iodine number being 2 or less, and ratio of tertiary carbon to total carbon being 6.3% or more".

Kinematic viscosity at 100 degree C. of the (A1) component is 1 to 8 $mm^2/s$; it is preferably 3 to 6 $mm^2/s$, more preferably 3.5 to 5 $mm^2/s$, further more preferably 3.8 to 4.5 $mm^2/s$ When kinematic viscosity at 100 degree C. of the (A1) component becomes over 8 $mm^2/s$, property of low-temperature viscosity is deteriorated. On the other hand, when the kinematic viscosity is less than 1 $mm^2/s$, lubricity becomes poor because of insufficient oil film forming at lubricating areas; in addition, evaporation loss of the lubricant base oil becomes larger, these of which are not preferable. Moreover, the kinematic viscosity at 40 degree C. of the (A1) component, for similar reasons, is preferably 5 to 100 $mm^2/s$, more preferably 10 to 40 $mm^2/s$, further more preferably 15 to 25 $mm^2/s$, and particularly preferably 16 to 22 $mm^2/s$.

Pour point of the (A1) component is −15 degree C. or less; it is preferably −17.5 degree C. or less. The lower limit is not specifically restricted to; in view of economic efficiency in the dewaxing process as well as property of low-temperature viscosity, it is preferably −45 degree C. or more, more preferably −30 degree C. or more, further more preferably −25 degree C. or more, and particularly preferably −20 degree C. or more. When pour point of the (A1) component is set at −15 degree C. or less, it is possible to obtain a lubricating oil composition which exhibits excellent property of low-temperature viscosity. For the dewaxing process, any one of processes like solvent dewaxing and/or catalytic dewaxing may be applied. However, as property of low-temperature viscosity can be improved even if the pour point is set within the above range of particularly preferable lower limit or more, moreover as the high-temperature detergency and the hydrolytic stability are excellent, the process of catalytic dewaxing is particularly preferable.

In order to obtain a lubricating oil composition which is excellent in high-temperature detergency and hydrolytic stability, aniline point of the (A1) component is 100 degree C. or more, more preferably 104 degree C. or more, and further more preferably 108 degree C. or more. The upper limit is not particularly restricted to; it may be 125 degree C. or more as a mode of the present invention, in view of superior solubility of additives and sludge as well as compatibility to sealing materials, the upper limit is preferably 125 degree C. or less, and further more preferably 120 degree C. or less.

So as to improve high-temperature detergency and hydrolytic stability, the paraffinic content in the saturates of the (A1) component is 40 mass % or more, preferably 47 mass % or more. The upper limit is not particularly restricted to, it may be 70 mass % or more as a mode of the invention; in view of superior solubility of additives and sludge, the upper limit is preferably 70 mass % or less. In this respect, since property of low-temperature viscosity as well as high-temperature detergency and hydrolytic stability are superior, the upper limit is more preferably 65 mass % or less, further more preferably 60 mass % or less, and particularly preferably 57 mass % or less.

The naphthenic content (monocyclic to hexacyclic naphthenic content) in the saturates of the (A1) component is 60 mass % or less depending on the above paraffinic content; it is preferably 53 mass % or less. The lower limit is not specifically restricted to, it may be 30 mass % or less as a mode of the invention; in view of superior solubility of additives and sludge, the lower limit is preferably 30 mass % or more. In this respect, since property of low-temperature viscosity as well as high-temperature detergency and hydrolytic stability are superior, the lower limit is more preferably 35 mass % or more, further more preferably 40 mass % or more, and particularly preferably 43 mass % or more.

The monocyclic naphthenic content in the saturates of the (A1) component is 25 mass % or less; it is preferably 23 mass % or less. The lower limit is not particularly restricted to, it may be less than 10 mass % as a mode of the invention; in view of superior solubility of additives and sludge, the lower limit is preferably 10 mass % or more, more preferably 15 mass % or more, and further more preferably 18 mass % or more.

The bicyclic to hexacyclic naphthenic content in the saturates of the (A1) component is 35 mass % or less; it is preferably 32 mass % or less. The lower limit is not specifically restricted to, it may be less than 10 mass % as a mode of the invention; in view of superior solubility of additives and sludge, the lower limit is preferably 10 mass % or more, more preferably 20 mass % or more, and further more preferably 25 mass % or more.

Moreover, a total of the paraffinic content and the monocyclic naphthenic content in the saturates of the (A1) component is not specifically restricted to; it is preferably 50 mass % or more, more preferably 60 mass % or more, further more preferably 65 mass % or more, and particularly preferably 68 mass % or more. The total mass may be 90 mass % or more as a mode of the invention, since the solubility of additives and sludge is superior, it is preferably 90 mass % or less, more preferably 80 mass % or less, and further more preferably 76 mass % or less.

The ratio between the paraffinic content in the saturates of the (A1) component and the monocyclic naphthenic content in the saturates (paraffinic content/monocyclic naphthenic content) is not specifically restricted to. As a mode of the invention, the ratio may be 10 or more, in view of superior solubility of additives and sludge, it is preferably 10 or less. In this respect, since the property of low-temperature viscosity is superior, it is more preferably 5 or less, further preferably 3.5 or less, and particularly preferably 3.0 or less.

It should be noted that the paraffinic content and the naphthenic content in the saturates of the (A1) component respectively means an alkane content (unit: mass %) and a naphthenic content (measuring object: monocyclic to hexacyclic naphthene, unit: mass %) being determined in accordance with ASTM D 2786-91.

In addition, the iodine number of the (A1) component should be 2 or less, it is preferably 1 or less, more preferably 0.7 or less, further more preferably 0.5 or less, and particularly preferably 0.1 or less. The iodine number of the (A1) component may be less than 0.001; in view of relatively small effect with the iodine number and economic efficiency, it is preferably 0.001 or more, more preferably 0.01 or more. When setting the iodine number of the lubricant base oil to 2 or less, it is capable of improving high-temperature detergency and hydrolytic stability. It should be noted that the "iodine number" of the present invention means an iodine number determined in accordance with an indicator titration method described in JIS K 0070 "Test methods for acid number, saponification number, ester number, iodine number, hydroxyl number and unsaponifiable matter of chemical products".

Ratio of tertiary carbon to a total of constituent carbon of the (A1) component should be 6.3% or more; it is preferably 12% or less, more preferably 6.6 to 10%, furthermore preferably 7.2 to 9%, and particularly preferably 7.5 to 8.5%. By setting the ratio of tertiary carbon within the above range, it is capable of obtaining a lubricant base oil which is excellent in viscosity-temperature property and high-temperature detergency as well as hydrolytic stability. Here, "ratio of tertiary carbon" means the ratio of carbon atoms attributed to ">CH—" (methine being bound to three carbon atoms) to a total of constituent carbon atoms, as it were, ratio of carbon atoms attributed to branching or naphthene.

In the present invention, "ratio of tertiary carbon to the total constituent carbon of the (A1) component" means a ratio of the total integrated intensity (determined by $^{13}$C-NMR) attributed to tertiary carbon to the total integrated intensity (determined by $^{13}$C-NMR) of the whole carbon. In other words, when (a) a total integrated intensity of chemical shift in region of 10 to 50 ppm (the total integrated intensity attributed to the total constituent carbon) and (c) a total integrated intensity of chemical shift in region of 27.9 to 28.1 ppm, 28.4 to 28.6 ppm, 32.6 to 33.2 ppm, 34.4 to 34.6 ppm, 37.4 to 37.6 ppm, 38.8 to 39.1 ppm, and 40.4 to 40.6 ppm (a total integrated intensity attributed to methyl, ethyl, other branched tertiary carbons, and naphthene tertiary carbons) are respectively determined, it means a ratio of (c) (%) to (a) being set to 100%.

In the invention, $^{13}$C-NMR measurement is carried out by dissolving 0.5 g of test sample in 3 g of deuterated chloroform and treating the resultant by gate decoupling method with resonant frequency of 100 MHz at room temperature. Measurement conditions for calculation of the "ratio of tertiary carbon to the total constituent carbon of the (A1) component" are not limited to it; as long as the correct results can be obtained, other measurement conditions can be used. Further, measurement method is not limited to $^{13}$C-NMR measurement; as long as equivalent results can be obtained, other measurement methods can be used.

Also, % $C_A$ of the (A1) component is not specifically restricted to; so as to enhance thermal/oxidation stability, viscosity-temperature property, high-temperature detergency, and hydrolytic stability, it is 2 or less, preferably 1 or less, further more preferably 0.5 or less, and particularly preferably 0.2 or less.

In addition, % $C_P$ of the (A1) component is not particularly limited to; as thermal/oxidation stability, viscosity-temperature property, high-temperature detergency, and hydrolytic stability can be enhanced, it is preferably 70 or more, more preferably 75 or more, and further more preferably 80 or more. The upper limit is not specifically restricted to, it may be 90 or more as a mode of the invention; in view of superior solubility of additives and sludge, it is preferably 90 or less, more preferably 85 or less.

Further, % $C_N$ of the (A1) component is not specifically restricted to; since it is capable of enhancing thermal/oxidation stability, viscosity-temperature property, high-temperature detergency, and hydrolytic stability, % $C_N$ is preferably 28 or less, more preferably 25 or less. The lower limit is not also specifically restricted to, it may be less than 10 as a mode of the invention; in view of superior solubility of additives and sludge, it is preferably 10 or more, more preferably 15 or more.

Still further, % $C_P$/% $C_N$ of the above (A1) component is not specifically limited to; since it is capable of enhancing thermal/oxidation stability and viscosity-temperature property, % $C_P$/% $C_N$ is preferably 2 or more, more preferably 2.4 or more, and particularly preferably 4.0 or more. The upper limit is not particularly restricted to, it may be 5 or more as a mode of the invention; in view of superior solubility of additives and sludge, it is preferably 5 or less, more preferably 4.5 or less.

It should be noted that % $C_A$, % $C_P$, and % $C_N$ respectively means: percentage of aromatic carbon number to total carbon number; percentage of paraffinic carbon number to total carbon number; and percentage of naphthenic carbon number to total carbon number, each of which is determined by method (n-d-M ring analysis) in accordance with ASTM D 3238-85.

Content of the saturates of the (A1) component is not particularly limited to; as thermal/oxidation stability, viscosity-temperature property, high-temperature detergency, and hydrolytic stability can be enhanced, it is preferably 90 mass % or more, more preferably 94 mass % or more, further more preferably 98 mass % or more, and particularly preferably 99 mass % or more.

The aromatic content of the (A1) component is not particularly limited to; as thermal/oxidation stability, viscosity-temperature property, high-temperature detergency, and hydrolytic stability can be enhanced, it is preferably 10 mass % or less, more preferably 6 mass % or less, further more preferably 2 mass % or less, and particularly preferably 1 mass % or less.

It should be noted that content of the saturates and aromatics of the invention means the value determined in accordance with ASTM D 2007-93 (unit: mass %).

Sulfur content of the (A1) component is not specifically limited to; it is preferably 0.1 mass % or less, more preferably 0.05 mass % or less, further more preferably 0.01 mass % or less, and particularly preferably 0.001 mass % or less.

Nitrogen content of the (A1) component is not specifically limited to; since it is capable of obtaining a composition which exhibits excellent thermal/oxidation stability, high-temperature detergency, and hydrolytic stability, it is preferably 5 mass ppm or less, more preferably 3 mass ppm or less.

Viscosity index of the (A1) component is not particularly limited to; since it is possible to obtain a composition which is excellent in thermal/oxidation stability, high-temperature detergency, and hydrolytic stability, it is preferably 100 or more, more preferably 110 or more, further more preferably 115 or more, and particularly preferably 120 or more. As a mode of the invention, the viscosity index of the (A1) component may be 135 or more, in view of superior solubility of additives and sludge, it is preferably 135 or less, more preferably 130 or less.

NOACK volatility of the (A1) component is not specifically limited to; it is preferably 2 to 25 mass %, more preferably 5 to 20 mass %, and further more preferably 10 to 15 mass %. By setting NOACK volatility of the (A1) component within the above range, it is particularly preferable as high-temperature detergency, hydrolytic stability, property of low-temperature viscosity, anti-wear property, and fatigue life can be enhanced in a well-balanced manner. It should be noted that the NOACK volatility in the invention means evaporation loss determined in accordance with ASTM D 5800-95.

So long as the (A1) component has the above properties, the manufacturing method thereof is not specifically limited. A preferable example of lubricant base oil of the invention, particularly, is the one obtained from the following method: the base oils (1) to (8) shown below are used as the raw materials; the raw material oil and/or a lubricating oil fraction being recovered from the raw material oil are/is refined by a predetermined refining method; and then, the lubricating oil fraction is recovered, so as to obtain the base oil.

(1) distillated oil obtained by topping of paraffinic crude oil and/or mixed crude;

(2) whole vacuum gas oil (WVGO), by vacuum distillation, of topped residue of paraffinic crude and/or mixed crude;

(3) wax (slack wax, etc.) obtained by lubricating oil dewaxing process and/or synthetic wax (Fischer-Tropsch wax, GTL wax, etc.) obtained by gas-to-liquid (GTL) process or the like;

(4) one of oil or a mixed oil of two or more base oils selected from (1) to (3) and/or mildly hydrocracked (MHC) oil of the mixed oil;

(5) a mixed oil of two or more base oils selected from (1) to (4);

(6) a de-asphalted oil (DAO) of the base oil (1), (2), (3), (4) or (5);

(7) a mildly hydrocracked (MHC) oil of the base oil (6); and (8) a mixed oil of two or more base oils selected from (1) to (7).

As the above predetermined refining methods, preferable examples include: hydroreforming such as hydrocracking and hydrofinishing; solvent refining such as furfural solvent extraction; dewaxing such as solvent dewaxing and catalytic dewaxing; clay treatment by acid clay, activated clay, and the like; and chemical (acid or alkali) treatment such as sulfuric acid treatment and caustic soda treatment. In this invention, refining may be carried out by one of these refining methods alone or by a combination of two or more thereof. When two or more refining methods are combined, the order of the procedure is not particularly limited; it can be adequately determined.

Further, as a lubricant base oil of the invention, it is particularly preferably the following base oil (9) or (10) obtained by giving specific treatment to a base oil selected from the above base oils (1) to (8) or a lubricating oil fraction which is recovered from these base oils.

(9) hydrocracked mineral oil obtained by firstly hydrocracking a base oil selected from the above base oils (1) to (8) or a lubricating oil fraction recovered from the base oils, then giving dewaxing treatment such as solvent dewaxing or catalytic dewaxing to the reaction product or the lubricating oil fraction recovered from the reaction product by distillation, and optionally distillating the resultant after dewaxing.

(10) hydroisomerized mineral oil obtained by firstly hydroisomerizing a base oil selected from the above base oils (1) to (8) or a lubricating oil fraction recovered from the base oils, then giving dewaxing treatment such as solvent dewaxing and catalytic dewaxing to the reaction product or the lubricating oil fraction recovered from the reaction product by distillation, and optionally distillating them after dewaxing.

When obtaining the above lubricant base oil of (9) or (10), as a dewaxing process, so as to enhance thermal/oxidation stability and property of low-temperature viscosity furthermore, at the same time, so as to enhance fatigue prevention performance of the lubricating oil composition, catalytic dewaxing process is particularly preferably included. Moreover, when obtaining the above lubricant base oil (9) or (10), as required, solvent refining treatment and/or hydrofinishing treatment may be further given.

The catalyst to be used for the hydrocracking and hydroisomerization is not particularly limited. It is preferably a hydrocracking catalyst, wherein a metal having ability of hydrogenation (e.g., one or more of metals of VIa group or VIII group, etc. in periodic table) is supported on a substrate made of composite oxide (e.g., silica-alumina, alumina-boria, and silica-zirconia) having cracking activity or made of a material having one composite oxide or a combination of two more of the composite oxides being adhered each other by binder. It is also preferably a hydroisomerization catalyst, wherein a metal having ability of hydrogenation containing at least one or more metals of VIII group is supported on a substrate containing zeolite (e.g., ZSM-5, zeolite beta, SAPO-11, etc.). The hydrocracking catalyst and hydroisomerization catalyst may be used in combination in a form of lamination or mixture thereof.

Reaction conditions during hydrocracking and hydroisomerization are not particularly limited to. The conditions are preferably set such that hydrogen partial pressure is 0.1 to 20 MPa, average reaction temperature is 150 to 450 degree C., LHSV is 0.1 to 3.0 $hr^{-1}$, hydrogen/oil ratio is 50 to 20000 scf/b. Here, "scf/b" means standard cubic-feet per barrel.

When carrying out catalytic dewaxing, hydrocracked/hydroisomerized oil is reacted with hydrogen under an effective conditions for lowering pour point under presence of adequate dewaxing catalyst. In catalytic dewaxing process, two or more lubricant base oils are obtained by converting a part of high boiling-point fraction existing in cracked/isomerized product into a low boiling-point fraction, by separating the low boiling-point fraction from heavier base oil fraction, and by fractionally distillating the base oil fraction. Separation of the low boiling-point fraction can be done before obtaining the objective lubricant base oil or during the fractional distillation.

As the dewaxing catalyst, it is not particularly limited as long as it can lower the pour-point of cracked/isomerized oil; it is preferably a catalyst which enables to obtain the objective lubricant base oil in high yield from the cracked/isomerized oil. As such a dewaxing catalyst, shape-selective molecular sieve is preferable; specifically, there may be ferielite, mordenite, ZSM-5, ZSM-11, ZSM-23, ZSM-35, ZSM-22 (it may be called as "theta one" or "TON".), and silica-alumina phophates (SAPO). These molecular sieves are preferably used in combination with catalytic metal component, more preferably used in combination with precious metal. An example of preferable combination thereof is a complex of platinum and H-mordenite.

The dewaxing condition is not particularly limited; the temperature is preferably 200 to 500 degree C. and hydrogen pressure is preferably 10 to 200 bar (1 to 20 MPa). When flow-through reactor is used, $H_2$ flow rate is preferably 0.1 to 10 kg/l/hr, LHSV is preferably 0.1 to 10 $h^{-1}$, and more preferably 0.2 to 2.0 $h^{-1}$. In addition, the method for dewaxing is preferably carried out such that a substance, which is contained in a cracked-isomerized oil at a ratio of normally 40 mass % or less, preferably 30 mass % or less and whose initial boiling point is 350 to 400 degree C., is to be converted into another substance having a boiling point less than the initial boiling point.

In the lubricating oil composition of the first invention, as long as the (A1) component is contained as a main component, a mineral base oil and/or synthetic base oil (excluding the (A1) component) used for conventional lubricating oil may be used in combination with the (A1) component. In this respect, content of the (A1) component, to the total mass of lubricant base oil, is preferably 50 to 99 mass %, more preferably 70 to 97 mass %, and further more preferably 85 to 95 mass %.

As a mineral base oil, the mineral base oil described as the (A) component can be used.

As a synthetic base oil, the synthetic base oil described as the (A) component can be used.

In the invention, as a lubricant base oil usable in combination with the (A1) component, the above mineral base oil, the above synthetic base oil, or arbitrary mixture of two or more selected from these can be used. For example, there may be one or more mineral base oils, one or more synthetic base oils, and a mixed oil of one or more mineral base oils and one or more synthetic base oils.

Among them, as a lubricant base oil usable in combination with the (A1) component, the above synthetic base oil is preferably used, poly-α-olefin base oil is particularly preferably used. Here, kinematic viscosity at 100 degree C. of the synthetic base oil, especially poly-α-olefin base oil is not specifically restricted to; normally, the one whose kinematic viscosity at 100 degree C. is 1 to 20 $mm^2/s$ can be used. So as to improve property of cold-temperature viscosity further more, poly-α-olefin base oil whose the kinematic viscosity is preferably 1 to 8 $mm^2/s$, more preferably 1.5 to 6 $mm^2/s$, further more preferably 1.5 to 4 $mm^2/s$, and particularly preferably 1.5 to 2.5 $mm^2/s$ can be desirably used.

Pour point of the synthetic base oil, particularly poly-α-olefin base oil is not specifically restricted, it is preferably −60 to −10 degree C., more preferably −55 to −30 degree C., further more preferably −50 to −40 degree C.

In view of enhancing the fatigue prevention performance, anti-wear property, and property of c low-temperature viscosity of the lubricating oil composition in a well-balanced manner, content of the lubricant base oil used in combination with the (A1) component, particularly content of the poly-α-olefin base oil, to the total mass of lubricant base oil, is preferably 1 to 50 mass %, more preferably 3 to 30 mass %, further more preferably 5 to 15 mass %.

In addition, the lubricant base oil of the invention is preferably a lubricant base oil made of the (A1) component or a mixed oil of the (A1) component and the mineral base oil or synthetic base oil. Kinematic viscosity at 100 degree C. thereof is desirably adjusted to be preferably 3 to 8 $mm^2/s$, more preferably 3.5 to 6 $mm^2/s$, and further more preferably 3.8 to 4.5 $mm^2/s$. Viscosity index thereof is also desirably adjusted to be preferably 100 or more, more preferably 110 or more, and further more preferably 115 or more.

<(B) Component, (B') Component, (B1) Component>

(B) Component in the lubricating oil composition of the present invention is a metallic detergent; specific examples thereof include: sulfonate detergent, phenate detergent, (B') salicylate detergent, and carboxylate detergent. These may be used alone or used in combination of a plurality of these detergents. In the invention, in view of excellent high-temperature detergency as well as particularly excellent hydrolytic stability, it is preferable to use the (B') salicylate detergent; use of metal salt of alkyl salicylic acid containing the (B1) dialkyl salicylic acid and/or basic (overbased) salt thereof are/is particularly preferable.

As the sulfonate detergent, the structure is not particularly limited. The example thereof may be an alkali metal salt or an alkali earth metal salt of alkyl aromatic sulfonic acid obtained by sulfonation of alkyl aromatic compounds of molecular weight between 100 and 1500, preferably between 200 and 700. Among them, magnesium salt and/or calcium salt are/is particularly preferably used. As the alkyl aromatic sulfonic acid, specifically, there may be the so-called "petroleum sulfonate" and "synthetic sulfonate". As the petroleum sulfonate, conventionally, a compound obtained by sulfonation of alkyl aromatic compounds of mineral lubricating oil fraction or the so-called "mahogany acid" obtained as a by-product in the manufacturing of white oil, and the like. On the other hand, as the synthetic sulfonate, for example, a material obtained by that alkylbenzene having linear or branched alkyl, which is obtained as a by-product from manufacturing plant of alkylbenzene used as a raw material of detergent or obtained by alkylation of polyolefin into benzene, is used as a raw material and the alkylbenzene is sulfonated; or another material obtained by sulfonating dinonylnaphthalene. In addition, as sulfonating agents to sulfonate these alkyl aromatic compounds are not particularly limited; usually, fuming sulfuric acid and sulfate are used.

Moreover, examples of alkaline earth metal sulfonate include a neutral alkaline earth metal sulfonate obtained by directly reacting the above alkyl aromatic sulfonic acid with an alkaline earth metal base such as oxide or hydroxide of alkaline earth metal (magnesium and/or calcium) or by once making an alkali metal salt such as sodium salt or potassium salt and substituting with an alkaline earth metal salt. Other examples of sulfonate may include: a basic alkali earth metal sulfonate obtained by heating a mixture of the above neutral alkali earth metal sulfonate and excessive alkali earth metal salt or alkali earth metal base (hydroxide or oxide) under presence of water; carboxylate over-based alkali earth metal sulfonate and borate over-based alkali earth metal sulfonate, both of which can be obtained by reacting the above neutral alkali earth metal sulfonate with the base of alkali earth metal under presence of carbon dioxide and/or boric acid or borate.

In the invention, as the sulfonate detergent, the above neutral alkali earth metal sulfonate, basic alkali earth metal sulfonate, over-based alkali earth metal sulfonate, and the mixture thereof may be used. As the sulfonate detergent of the invention, calcium sulfonate detergent and magnesium sulfonate detergent are preferably used, using calcium sulfonate detergent is particularly preferable.

The sulfonate detergent is usually commercially-supplied and available in a form diluted with light lubricant base oil and the like. In general, a sulfonate detergent of which metal content is 1.0 to 20 mass %, preferably 2.0 to 16 mass % is desirably used.

The base number of the sulfonate detergent to be used for the invention is arbitrary; it is normally 0 to 500 mgKOH/g. Within the range, in view of superior high-temperature detergency, a sulfonate detergent whose base number is 0 to 400 mgKOH/g, preferably 200 to 400 mgKOH/g, and more preferably 250 to 350 mgKOH/g are desirably used. Here, "base number" means a number based on perchloric acid method measured in accordance with No. 7 in JIS K 2501 "Petroleum products and lubricating oil—Determination of neutralization number".

As the (B') salicylate detergent, the structure thereof is not particularly limited to; metal salt of a salicylic acid, preferably alkali metal salt or alkali earth metal salt, particularly magnesium salt and/or calcium salt, each of which has one or two $C_1$-$C_{40}$ alkyls.

As (B') salicylate detergent of the invention, as high-temperature detergency and hydrolytic stability are superior, metal salt of alkyl salicylic acid containing (B1) dialkyl salicylic acid and/or the basic (overbased) salt thereof are/is preferable. Namely, the salicylate detergent, in which component ratio of the dialkyl salicylic acid metal salt is over 0 and 100 mol % or less, preferably 5 mol % or more, more preferably 10 mol % or more, is favorable. While, as the (B') salicylate detergent, in view of superior property of cold-temperature viscosity, monoalkyl salicylic acid metal salt may be preferably contained at higher component ratio. For example, it is preferably an alkyl salicylic acid metal salt and/or the basic (overbased) salt thereof, wherein the component ratio of monoalkyl salicylic acid metal salt is 85 mol % or more and less than 100 mol %, the component ratio of dialkyl salicylic acid metal salt is over 0 and 15 mol % or less, and the component ratio of 3-alkyl salicylic acid metal salt and/or the (over)based salt thereof is 40 mol % or more and less than 100 mol %.

The monoalkyl salicylic acid metal salt in this context means an alkyl salicylic acid metal salt having one alkyl group such as 3-alkyl salicylic acid metal salt, 4-alkyl salicylic acid metal salt, and 5-alkyl salicylic acid metal salt. The component ratio of monoalkyl salicylic acid metal salt, to 100 mol % of alkyl salicylic acid metal salt, is 85 to 100 mol %, preferably 88 to 98 mol %, and further more preferably 90 to 95 mol %. The component ratio of alkyl salicylic acid metal salt other than the monoalkyl salicylic acid metal salt, e.g., component ratio of dialkyl salicylic acid metal salt, is 0 to 15 mol %, preferably 2 to 12 mol %, and more preferably 5 to 10 mol %. Further, the component ratio of 3-alkyl salicylic acid metal salt, to 100 mol % of alkyl salicylic acid metal salt, is 40 to 100 mol %, preferably 45 to 80 mol %, and more preferably 50 to 60 mol %. In addition, the component ratio of the sum of 4-alkyl salicylic acid metal salt and 5-alkyl salicylic acid metal salt, to 100 mol % of alkyl salicylic acid metal salt, is equivalent to the component ratio where the component ratios of the above 3-alkyl salicylic acid metal salt and dialkyl salicylic acid metal salt are substracted; in other words, it is 0 to 60 mol %, preferably 20 to 50 mol %, and more preferably 30 to 45 mol %. If small amount of dialkyl salicylic acid metal salt is contained, it is capable of obtaining a composition which is excellent in high-temperature detergency, low-temperature properties, and property of hydrolytic stability. Moreover, by setting the component ratio of 3-alkylsalicylate at 40 mol % or more, it is capable of making the component ratio of 5-alkyl salicylic acid metal salt relatively lower and improving the oil solubility.

Examples of alkyl group of alkyl salicylic acid metal salt composing the (B') salicylate detergent include: $C_{10}$-$C_{40}$ alkyl, preferably $C_{10}$-$C_{19}$ or $C_{20}$-$C_{30}$ alkyl, further more preferably $C_{14}$-$C_{18}$ or $C_{20}$-$C_{26}$ alkyl, and particularly preferably $C_{14}$-$C_{18}$ alkyl. Examples of $C_{10}$-$C_{40}$ alkyl include: decyl, undecyl, dodecyl, tridecyl, tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, and triacontyl. These alkyls may be linear or branched; these may also be primary alkyl, secondary alkyl, or tertiary alkyl. In the present invention, in order to easily obtain the above desired salicylic acid metal salt, secondary alkyl is particularly preferable.

Further, examples of metal in the alkyl salicylic acid metal salt include: alkali metal such as sodium and potassium; alkaline earth metal such as calcium and magnesium; and the like. It is preferably calcium and magnesium, particularly preferably calcium.

The (B') salicylate detergent of the invention can be manufactured by a known method; the method is not specifically restricted. For example, it can be obtained by alkylation of 1 mol of phenol by using 1 mol or more of $C_{10}$-$C_{40}$ olefin such as polymer, copolymer or the like of ethylene, propylene, butene, and so on, preferably a linear α-olefin like ethylene polymer, and then, by carboxylation of the resultant using carbon dioxide gas thereafter. Or, it can also be obtained: by reacting an alkyl salicylic acid having monoalkyl salicylic acid as a main component obtained by alkylating 1 mol of salicylic acid by using 1 mole or more of the olefin, preferably the linear α-olefin, with metallic base such as oxide and/or hydroxide of alkali metal or alkali earth metal; by making the alkyl salicylic acid be converted into an alkali metal salt such as sodium salt and potassium salt; or further by substituting the alkali metal salt with alkali earth metal salt. Here, by controlling the molar ratio of phenol or salicylic acid with olefin to preferably e.g., 1:1-1.15 (molar ratio), more preferably 1:1.05-1.1 (molar ratio), it is capable of controlling the component ratio between monoalkyl salicylic acid metal salt and dialkyl salicylic acid metal salt to the desirable ratio. In addition, by using the linear α-olefin as an olefin, it is capable of easily controlling the component ratio among 3-alkyl salicylic acid metal salt, 5-alkyl salicylic acid metal salt, and the like to the desirable ratio. Moreover, by doing these, it is possible to obtain an alkyl salicylic acid metal salt having a secondary alkyl, as a main component, which is preferable for the present invention; thereby it is particularly preferable. When branched olefin is used as an olefin, mostly, 5-alkyl salicylic acid metal salt only tends to be obtained. However, it is necessary to mix 3-alkyl salicylic acid metal salt and the like to obtain the desirable composition for improving the oil solubility, which complicates the manufacturing process; thus it is not preferable.

The (B') salicylate detergent of the invention may be a basic salt obtained by adding further excessive alkali metal salt/alkali earth metal salt or alkali metal base/alkali earth metal base (hydroxide or oxide of alkali metal or alkali earth metal) to the alkali metal salicylate or alkali earth metal salicylate (neutral salt) obtained in the above-described method and heating this under existence of water; or it may be an overbased salt obtained by reacting the above neutral salt with a base such as hydroxide of alkali metal or alkali earth metal under existence of carbon dioxide and/or boric acid or borate.

These reactions are usually carried out in solvent (e.g., aliphatic hydrocarbon solvents like hexane, aromatic hydrocarbon solvent like xylene, and light lubricant base oil, etc.). The metal content is desirably 1.0 to 20 mass %, preferably 2.0 to 16 mass %.

As the particularly preferable (B') salicylate detergent used for the invention, in view of superior balance among high-temperature detergency, hydrolytic stability, and property of low-temperature viscosity, it is alkyl salicylic acid metal salt, and/or the basic (overbased) salt thereof, in which component ratio: of monoalkyl salicylic acid metal salt is 85 to 95 mol %, of dialkyl salicylic acid metal salt is 5 to 15 mol %, of 3-alkyl salicylic acid metal salt is 50 to 60 mol %, and the sum of component ratio of 4-alkyl salicylic acid metal salt and 5-alkyl salicylic acid metal salt is 35 to 45 mol %. The alkyl group in this context is particularly preferably secondary alkyl.

In the invention, base number of the (B') salicylate detergent is normally 0 to 500 mgKOH/g, preferably 20 to 300 mgKOH/g, and more preferably 100 to 200 mgKOH/g, and particularly preferably 150 to 200 mgKOH/g; one or a combination of two or more selected from the above can be used. The "base number" means a base number based on perchloric acid method in which the base number is measured in accordance with No. 7 in JIS K 2501 "Petroleum products and lubricating oil—Determination of neutralization number".

Specific examples of the phenate detergent include: alkylphenol sulfide obtained by reacting sulfur with an alkylphenol having at least one $C_4$-$C_{30}$ alkyl, preferably $C_6$-$C_{18}$ linear or branched alkyl; or an alkaline earth metal salt, particularly the magnesium salt and/or calcium salt, etc. of Mannich reaction product, which is obtained by reacting formaldehyde with the alkylphenol. The base number of the phenate detergent is normally 0 to 500 mgKOH/g, preferably 20 to 450 mgKOH/g, and more preferably 150 to 300 mgKOH/g.

In the lubricating oil composition of the present invention, content of the (B) component, to a total mass of the composition, is 0.005 to 0.5 mass % as metal content; it is preferably 0.01 to 0.3 mass %, more preferably 0.04 to 0.25 mass %, and particularly preferably 0.16 to 0.24 mass %.

<(C) Component>

(C) Component in the lubricating oil composition of the present invention is succinimide ashless dispersant. Examples of the succinimide ashless dispersant include: a succinimide having at least one preferably $C_{40}$-$C_{400}$ alkyl or alkenyl, more preferably $C_{60}$-$C_{350}$ alkyl or alkenyl in the molecule; and derivatives obtained by modifying a combination of the above succinimide and one or more selected from the group consisting of: boric acid or borate; $C_2$-$C_{30}$ monocarboxylic acid (fatty acid, and so on); $C_2$-$C_{30}$ polycarboxylic acid such as oxalic acid, phthalic acid, trimellitic acid, and pyromellitic acid; phosphorus-containing acid such as phosphoric acid, phosphorous acid, acidic phosphate (phosphite) ester; and sulfur-containing compounds. The succinimide may be mono-type or bis-type; bis-type is particularly preferable.

The above $C_{40}$-$C_{400}$ alkyl or alkenyl may be linear or branched; it may preferably be branched. More specifically, there may be a $C_{40}$-$C_{400}$ branched alkyl or branched alkenyl, preferably a $C_{60}$-$C_{350}$ branched alkyl or branched alkenyl which is derived from an oligomer of olefin such as propylene, 1-butene, and isobutylene or cooligomer of ethylene and propylene, and so on. When carbon number of the alkyl or alkenyl is less than 40, effect of the compounds as an ashless dispersant is hard to be obtained. On the other hand, when carbon number of the alkyl or alkenyl is over 400, cold flow property of the composition tends to be deteriorated.

As the (C) component of the present invention, in view of particularly excellent high-temperature detergency, boron-containing succinimide (C1) is preferably contained; in view of excellent hydrolytic stability, boron-free succinimide (C2) is preferably contained. Especially, in view of excellent properties of both high-temperature detergency and hydrolytic stability, the one containing the (C1) together with the (C2) may be preferably contained.

Boron content of the (C1) component is not specifically restricted to; it is normally 0.01 to 4 mass %. In view of balance between high-temperature detergency and hydrolytic stability, it is preferably 0.1 to 2.5 mass %, more preferably 0.2 to 1 mass, and further more preferably 0.4 to 0.8 mass %. For similar reasons, mass ratio (B/N ratio) of boron content to nitrogen content in the (C1) component is normally 0.01 to 2, preferably 0.1 to 1, further more preferably 0.2 to 0.5, and particularly preferably 0.3 to 0.4.

With regard to the content of the (C1) component of the invention, in view of excellent high-temperature detergency, to a total mass of the composition, as boron content, the lower limit is 0.001 mass % or more, preferably 0.005 mass % or more, more preferably 0.01 mass % or more, and furthermore preferably over 0.03 mass %. On the other hand, the upper limit is 0.2 mass % or less and preferably 0.1 mass % or less. Moreover, in view of excellent high-temperature detergency as well as particularly excellent hydrolytic stability, the lower limit is preferably 0.005 mass % or more, more preferably 0.01 mass % or more; the upper limit is preferably 0.03 mass % or less, further more preferably 0.025 mass % or less. Although when content of the (C1) component as boron content is over 0.03 mass, high-temperature detergency is superior, in view of compatibility with hydrolytic stability, it is desirably 0.03 mass % or less.

Further, content of the (C1) component of the invention, to normally a total mass of the composition, as nitrogen content, is 0.005 to 0.4 mass %. Because of excellent high-temperature detergency, content of the (C1) component is preferably 0.01 to 0.2 mass %, more preferably 0.03 to 0.15 mass %, and further more preferably 0.1 to 0.15 mass %. Still further, in view of excellent high-temperature detergency together with excellent hydrolytic stability, content of the (C1) component is preferably 0.03 to 0.1 mass %, and particularly preferably 0.04 to 0.08 mass %.

If (C2) component only is used as the (C) component, it is capable of obtaining the lubricating oil composition which is excellent in hydrolytic stability and in performance of base number retention at a time of moisture incorporation being significantly enhanced. In this respect, content of the (C2) component, to a total mass of the composition, as nitrogen content, is 0.005 mass % or more and 0.4 mass % or less. Since hydrolytic stability is particularly excellent, the lower limit of the (C2) component content is preferably 0.01 mass % or more, more preferably 0.08 mass % or more, and particularly preferably 0.12 mass % or more. In addition, the upper limit of the (C2) component content is preferably 0.2 mass % or less, more preferably 0.18 mass % or less, and preferably 0.15 mass % or less.

In the invention, the (C1) component and the (C2) component are preferably used at the same time. This enables to enhance high-temperature detergency together with performance of base number retention at a time of moisture incorporation so that it is possible to make the lubricating oil composition which exhibits these properties in a well-balanced manner.

In view of excellent hydrolytic stability, content of the (C1) component when using the (C1) component and the (C2) component at the same time, to a total mass of the composition, as boron content, must be 0.03 mass % or less; it is more preferably 0.025 mass % or less. In order to enhance high-temperature detergency further more, as boron content, it is preferably 0.001 mass % or more, more preferably 0.005 mass % or more, further more preferably 0.01 mass % or more, and particularly preferably 0.015 mass % or more. When content of the (C1) component is excessive, effect for improving hydrolytic stability sometimes becomes insufficient.

Content of the (C2) component when using the (C1) component and the (C2) component at the same time, to a total mass of the composition, as nitrogen content, is normally 0.005 mass % or more and 0.4 mass % or less. In view of excellent high-temperature detergency and particularly excellent hydrolytic stability, the lower limit of the nitrogen content is preferably 0.01 mass % or more, more preferably 0.03 mass % or more, and particularly preferably 0.04 mass % or more. Moreover, the upper limit of the nitrogen content is preferably 0.2 mass % or less, more preferably 0.15 mass % or less, and particularly preferably 0.08 mass % or less.

Since it is easy to be compatible with high-temperature detergency and hydrolytic stability, content of the (C) component in the lubricating oil composition of the invention, to a total mass of the composition, as nitrogen content, the lower limit is preferably 0.005 mass % or more, more preferably 0.01 mass % or more, and further more preferably 0.08 mass % or more. Moreover, the upper limit is preferably 0.4 mass % or less, more preferably 0.2 mass % or less, and further more preferably 0.15 mass % or less.

Further, in the lubricating oil composition of the invention, mass ratio of boron content and nitrogen content attributed to the (C) component, as it were, mass ratio (B/N ratio) of boron content attributed to the (C1) component to the total nitrogen content attributed to the (C1) component and the (C2) component is not specifically restricted to; in view of excellent high-temperature detergency, it is preferably 0.05 or more and 1.2 or less, more preferably 0.3 or more and 1 or less. In view of excellent high-temperature detergency and particularly excellent hydrolytic stability, the lower limit thereof is preferably 0.05 or more, more preferably 0.1 or more, and further more preferably 0.15 or more; the upper limit thereof is preferably 0.3 or less, more preferably 0.25 or less, and further more preferably 0.2 or less.

<(D) Component>

(D) Component in the lubricating oil composition of the present invention is a metal salt of phosphorus-containing acid. The metal salt of phosphorus-containing acid is not particularly limited to as long as it is a metal salt of acidic compounds containing phosphorus in the molecule; for example, it may be preferably at least one compound selected from the group consisting of: phosphorus compound represented by the general formula (1) or metal salt of the derivatives thereof; phosphorus compound represented by the general formula (2) or metal salt of the derivatives thereof; salt of the nitrogen-containing compound thereof or the complex thereof; and the derivatives these compounds.

(Formula 1)

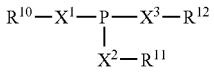

(1)

In the formula (1), $X^1$, $X^2$, and $X^3$ are independently an oxygen atom or a sulfur atom. $R^{10}$, $R^{11}$, and $R^{12}$ are independently a hydrogen atom or $C_1$-$C_{30}$ hydrocarbon.

(Formula 2)

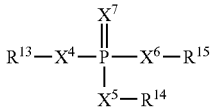

(2)

In the formula (2), $X^4$, $X^5$, $X^6$, and $X^7$ are independently an oxygen atom or a sulfur atom (one or two of $X^4$, $X^5$, and $X^6$ may be bound by single bond or (poly) oxyalkylene.). $R^{13}$, $R^{14}$, and $R^{15}$ are independently a hydrogen atom or $C_1$-$C_{30}$ hydrocarbon.

Examples of $C_1$-$C_{30}$ hydrocarbon represented by the above $R^{10}$ to $R^{15}$ include: alkyl, cycloalkyl, alkenyl, alkyl-substituted cycloalkyl, aryl, alkyl-substituted aryl, and arylalkyl. These hydrocarbons may preferably be $C_1$-$C_{30}$ alkyl or $C_6$-$C_{24}$ aryl, further more preferably $C_3$-$C_{18}$ alkyl, and particularly preferably $C_4$-$C_{12}$ alkyl. These hydrocarbons may contain any of an oxygen atom, a nitrogen atom, and a sulfur atom in the molecule; however, a hydrocarbon consisting of carbon atom and hydrogen atom is desirable.

Examples of the phosphorus compound represented by the general formula (1) include: phosphorous acid, monothio phosphite, dithio phosphite, and trithio phosphite; phosphite monoester, monothio phosphite monoester, dithio phosphite monoester, and trithio phosphite monoester, respectively having one of the above $C_1$-$C_{30}$ hydrocarbons; phosphite diester, monothio phosphite diester, dithio phosphate diester, and trithio phosphite diester, respectively having two of the $C_1$-$C_{30}$ hydrocarbons; phosphite triester, monothio phosphite triester, dithio phosphite triester, trithio phosphite triester respectively having three of the $C_1$-$C_{30}$ hydrocarbons; and mixture of these compounds.

Examples of the phosphorus compound represented by the general formula (2) include: phosphoric acid, monothio phosphate, dithio phosphate, trithio phosphate, and tetrathio phosphate; phosphate monoester, monothio phosphate monoester, dithio phosphate monoester, trithio phosphate monoester, and tetrathio phosphate monoester, respectively having one of the above $C_1$-$C_{30}$ hydrocarbons; phosphate diester, monothio phosphate diester, dithio phosphoric acid diester, trithio phosphate diester, and tetrathio phosphate diester, respectively having two of the above $C_1$-$C_{30}$ hydrocarbons; phosphate triester, monothio phosphate triester, dithio phosphate triester, trithio phosphate triester, and tetrathio phosphate triester, respectively having three of the above $C_1$-$C_{30}$ hydrocarbons; phosphonic acid, phosphonate monoester, and phosphonate diester, respectively having one to three of the above $C_1$-$C_{30}$ hydrocarbons; the above phosphorus compounds having $C_1$-$C_4$ (poly) oxyalkylene; the derivatives of the phosphorus compounds of reactant from β-dithio phosphorylise propionic acid or dithiophosphoric acid and olefin cyclopentadiene or (methyl)methacrylate; and mixture of these compounds.

Examples of the metal salt of the phosphorus compounds represented by the general formula (1) or (2) may be a salt obtained by reacting a phosphorus compound with a nitrogen compound such as: a metal base like metal oxide, metal hydroxide, metal carboxylate, and metal chloride; ammonia; or an amine compound having only $C_1$-$C_{30}$ hydrocarbon or hydroxyl group-containing hydrocarbon in the molecule, and then by neutralizing a part of or whole the remaining acidic hydrogen.

Specific examples of metal regarding the above metal base include: alkali metal such as lithium, sodium, potassium, and cesium; alkaline earth metal such as calcium, magnesium, and barium; and heavy metal such as zinc, copper, iron, lead, nickel, silver, manganese, and molybdenum. Among them, zinc as well as alkaline earth metal like calcium and magnesium are preferable.

Specific examples of the above nitrogen-containing compound include: ammonia; nitrogen compounds such as amine compounds having $C_1$-$C_{30}$ hydrocarbon or hydroxyl group-containing hydrocarbon in the molecule, amide bond-containing compounds, and imide bond-containing compounds; the (C) component; and ashless dispersant other than this.

More specifically, there may be amine-containing nitrogen compounds such as monoamine, diamine, polyamine, and alkanolamine; nitrogen-containing compounds having amide bonds; nitrogen-containing compounds having imide bonds; and so on. Among these nitrogen compounds, nitrogen-containing compounds (these may be linear or branched.) having $C_{10}$-$C_{20}$ alkyl or alkenyl like decyl amine, dodecyl amine, dimethyl dodecyl amine, tridecyl amine, heptadecyl amine, octadecyl amine, oleyl amine, and stearyl amine may be the preferable examples.

With respect to the (D) component of the invention, as the metal salt of the phosphorus-containing acid, particularly desirably, at least one selected from the following (D1) component and (D2) component as the main component is contained in the lubricating oil composition of the invention.

(D1) component: zinc dialkyldithiophosphate (D2) component: salt of metal base with phosphorus-containing acid whose sulfur content is less than content of the (D1) component or in which sulfur atom is not contained.

Example of the (D1) component may be the one represented by the following general formula (3).

(Formula 3)

(3)

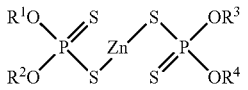

In the formula, $R^1$, $R^2$, $R^3$, and $R^4$ are the same or different, these independently are $C_1$-$C_{30}$, preferably $C_3$-$C_8$ secondary alkyl or primary alkyl; these are preferably $C_3$-$C_6$ secondary alkyl or $C_6$-$C_8$ primary alkyl; alkyls of different carbon number and/or alkyls (secondary, primary) of different structure may be included in the same molecule.

In the present invention, as the (D1) component, in view of excellent anti-wear property, zinc dialkyldithiophosphate having $C_3$-$C_8$ secondary alkyl, more preferably $C_4$ and/or $C_6$ secondary alkyl may be preferably contained. Moreover, in order to improve oxidation stability and to enhance performance of base number retention, zinc dialkyldithiophosphate having $C_3$-$C_8$ primary alkyl may be preferably contained in the (D1) component. These can be used at the same time.

It should be noted that manufacturing method of zinc dithiophosphate may be any kind of conventional method so that it is not specifically restricted to. More specifically, for instance, zinc dithiophosphate can be synthesized by reacting diphosphorus pentasulfide with an alcohol having alkyl corresponding to the above $R^1$, $R^2$, $R^3$, and $R^4$ to produce dithiophosphoric acid, and then by neutralizing this with zinc oxide.

In addition, typical examples of the (D2) component include: a metal salt of phosphorus compound in which all of $X^1$ to $X^3$ in the general formula (1) are oxygen atoms (one or two of $X^1$, $X^2$, and $X^3$ may be bound by single bond or (poly) oxyalkylene.); a metal salt of phosphorus compound in which all of $X^4$ to $X^7$ in the general formula (2) are oxygen atoms (one or two of $X^4$, $X^5$, and $X^6$ may be bound by single bond or (poly) oxyalkylene.). In view of ability to significantly enhance long-drain performance such as high-temperature detergency, oxidation stability, and base number retention, the (D2) component can be preferably used.

The metal salts of the above phosphorus compound have different structures depending on the metal valency and/or number of hydroxyl group in the phosphorus compound so that the structure is not particularly restricted to. For example, when 1 mole of zinc oxide and 2 moles of phosphate diester (having one hydroxyl group) are reacted, a compound having a structure represented by the general formula (4) is thought to be obtained as the main component; at the same time, polymerized molecules are also thought to be existed.

(Formula 4)

(4)

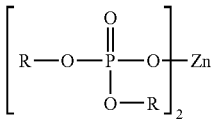

Moreover, for instance, when 1 mole of zinc oxide and 1 mole of phosphate monoester (having two hydroxyl groups) are reacted, a compound having a structure represented by the following general formula (5) is thought to be obtained as the main component; at the same time, polymerized molecules are also thought to be existed.

(Formula 5)

(5)

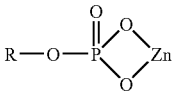

Among the (D2) component, it is preferably a salt of zinc with phosphite diester having two $C_3$-$C_{18}$ alkyl or aryl, a salt of zinc with phosphate monoester having one $C_3$-$C_{18}$ alkyl or aryl, a salt of zinc with phosphate diester having two $C_3$-$C_{18}$ alkyl or aryl, or a salt of zinc with phosphonate monoester having two $C_1$-$C_{18}$ alkyl or aryl. Among them, phosphate monoester having $C_4$-$C_{12}$ alkyl, preferably $C_6$-$C_{10}$ alkyl and/or zinc salt of phosphate diester having $C_4$-$C_{12}$ alkyl, preferably $C_6$-$C_{10}$ alkyl are/is desirably used in view of good balance among oil solubility, anti-wear property, and economic efficientcy. About these components, one or two thereof can be optionally mixed.

As for content of (D) metal salt of phosphorus-containing acid in the lubricating oil composition of the present invention, preferably content of at least one selected from the (D1) and the (D2) , to a total mass of the composition, the upper limit as phosphorus content is 0.2 mass % or less, preferably 0.1 mass % or less, more preferably 0.08 mass % or less, and particularly preferably 0.06 mass % or less. On the other hand, the lower limit, in terms of easiness of inhibiting wear, as phosphorus content, is 0.005 mass % or more, preferably 0.02 mass % or more, and particularly preferably 0.04 mass % or more.

By the above described composition, the lubricating oil composition for internal combustion engine of the invention may become a composition having excellent high-temperature detergency. It may also become a composition which exhibits favorable hydrolytic stability together with excellent high-temperature detergency; for the purpose of improving the performance further more or imparting necessary properties to the lubricating oil composition for internal combustion engine, a known lubricating oil additives can be given. Examples of additives which can be adequately added include: ashless dispersant other than the (C) component, extreme pressure additive other than the (D) component, viscosity index improver, friction modifier, antioxidant, metal deactivator, rust inhibitor, corrosion inhibitor, pour-point depressant, rubber swelling agent, defoamant, and coloring agent. These can be used alone or used in combination of two or more thereof.

Examples of ashless dispersant other than the (C) component include: a nitrogen-including compound, such as benzyl amine and polyamine, having at least one $C_{40}$-$C_{400}$ alkyl or alkenyl, preferably $C_{60}$-$C_{350}$ alkyl or alkenyl in the molecule; derivatives thereof; or modified articles. The $C_{40}$-$C_{400}$ alkyl or alkenyl may be linear or branched. Preferable examples, specifically, may be branched alkyl or alkenyl derived from oligomer of olefin like propylene, 1-butene, and isobutylene or co-oligomer of ethylene and propylene. In the lubricating oil composition of the invention, one compound or two or more compounds optionally selected from these can be contained at adequate amount. Normally, the content, to a total mass of the lubricating oil composition, is 0.1 to 10 mass %, preferably 1 to 6 mass %.

With respect to extreme pressure additive other than the (D) component, the extreme pressure additive other than optional compounds normally used as an extreme pressure additive for lubricating oil can be used. For example, there may be: sulfur compounds such as dithio carbamates, sulfides, sulfurized olefins, and sulfurized fat; phosphoric acid, phosphate esters, phosphorous acid, phosphite esters, and amine salt thereof. In the invention, one compound or two or more compounds optionally selected from these can be contained at adequate amount. Normally, the content, to a total mass of the lubricating oil composition, is 0.01 to 5.0 mass %.

Specific examples of viscosity index improver include: the so-called "non-dispersant viscosity index improver" like copolymer of one or more monomers selected from various methacrylic acid esters or the hydrogenated product thereof; or the so-called "dispersive viscosity index improver" obtained by copolymerizing various methacrylic acid esters containing nitrogen compounds. Specific example of other viscosity index improvers include: a non-dispersive/dispersive ethylene-α-olefin copolymer (examples of α-olefin may be propylene, 1-butene, and 1-pentene) or the hydrogenated product; polyisobutylene or the hydrogenated product; styrene-diene hydrogenated copolymer, styrene-maleic anhydride ester copolymer and polyalkyl styrene. In the invention, one compound or two or more compounds randomly selected from these viscosity index improver can be contained at adequate amount. Particularly, in view of ability to enhanve property of cold-temperature viscosity and fatigue prevention performance, viscosity index improver of the invention is preferably non-dispersive or dispersive polymethacrylate, particularly preferably non-dispersive polymethacrylate.

The weight-average molecular weight (Mw) of the viscosity index improver used in the present invention is usually 10000 to 1000000. Since fuel-saving effect as well as excellent shear stability can be expected, Mw is preferably 100000 to 600000, more preferably 200000 to 500000. In addition, content of the viscosity index improver in the lubricating oil composition of the invention is 0.01 to 20 mass preferably 5 to 15 mass %.

As the friction modifier, any compounds normally used as friction modifiers for lubricating oil can be used. Specific examples thereof include: ashless friction modifier having at least one $C_6$-$C_{30}$ alkyl or alkenyl, particularly $C_6$-$C_{30}$ linear alkyl or linear alkenyl in the molecule, such as aminic friction modifier, imidic friction modifier, amidic friction modifier, and fatty acidic friction modifier.

Examples of the aminic friction modifier include: $C_6$-$C_{30}$ linear or branched, preferably $C_6$-$C_{30}$ linear aliphatic monoamine; $C_6$-$C_{30}$ linear or branched, preferably $C_6$-$C_{30}$ linear aliphatic alkanolamine; linear or branched, preferably linear aliphatic polyamine; or aliphatic aminic friction modifier such as alkylene oxide adduct and so on of the above aliphatic amine.

Examples of imidic friction modifier include: a succinimide friction modifier such as: mono and/or bis succinimide having one or two $C_6$-$C_{30}$, preferably $C_8$-$C_{18}$ linear or branched, preferably $C_8$-$C_{18}$ branched hydrocarbon; succinimide modified compounds obtained by reacting the succinimide with one compound or two or more compounds selected from boric acid, phosphoric (phosphorous) acid, and $C_1$-$C_{20}$ carboxylic acid or sulfur-containing compounds.

Example of the amide friction modifier may be a fatty acid amide friction modifier obtained from $C_7$-$C_{31}$ linear or branched, preferably $C_7$-$C_{31}$ linear fatty acid with amine such as ammonia, aliphatic monoamine, or aliphatic polyamine.

Examples of the fatty acid friction modifier include: $C_7$-$C_{31}$ linear or branched, preferably $C_7$-$C_{31}$ linear fatty acid; fatty acid ester such as an ester of the fatty acid with aliphatic monovalent alcohol or aliphatic polyvalent alcohol; fatty acid metal salt like fatty acid alkaline earth metal salt (magnesium salt, calcium salt, etc.) or zinc salt of the fatty acid.

In the invention, one compound or a combination of two or more compounds randomly selected from these friction modifiers can be contained at adequate amount. Normally, the content, to a total mass of the lubricating oil composition, is 0.01 to 5.0 mass %, preferably 0.03 to 3.0 mass The antioxidant is not particularly limited to as long as it is conventionally used as a lubricating oil, like phenolic compounds and aminic compounds. Specific examples include: alkylphenols such as 2,6-di-tert-butyl-4-methylphenol; bisphenols such as methylene-4,4-bisphenol (2,6-di-tert-butyl-4-methylphenol); naphthyl amines such as phenyl-α-naphthyl amine; dialkyl diphenyl amines; ester of (3,5-di-tert-butyl-4-hydroxylphenyl) fatty acid (propionic acid, etc.) and monovalent/polyvalent alcohol (e.g. methanol, octadecanol, 1,6-hexadiol, neopentyl glycol, thio diethyleneglycol, triethylene glycol, pentaerythritol); phenothiazines; organometallic antioxidant derived from molybdenum, copper, and zinc; and a mixture thereof. In the invention, with respect to the excellent high-temperature detergency and ability to enhance performance of base number retention at a time of moisture incorporation, aminic antioxidant is particularly preferable. In the invention, one compound or a combination of two or more compounds optionally selected from these antioxidants can be contained at adequate amount. In general, the content, to a total mass of the lubricating oil composition, is 0.01 to 5.0 mass %.

As a metal deactivator, there may be thiazole compounds and thiadiazole compounds; thiadiazole compounds are preferably used. Examples of thiadiazole compounds include: 2,5-bis(alkyl thio)-1,3,4-thiadiazole having $C_6$-$C_{24}$ linear or branched alkyl group, 2,5-bis(alkyl dithio)-1,3,4-thiadiazole having $C_6$-$C_{24}$ linear or branched alkyl, 2-(alkyl thio)-5-mercapto-1,3,4-thiadiazole having $C_6$-$C_{24}$ linear or branched alkyl, 2-(alkyl dithio)-5-mercapto-1,3,4-thiadiazole having $C_6$-$C_{24}$ linear or branched alkyl, mixtures thereof. Among them, 5-bis(alkyl dithio)-1,3,4-thiadiazole is particularly preferable. Content of the metal deactivator, to a total mass of the composition, is 0.005 to 0.5 mass %.

Example of rust inhibitor may include: alkenyl succinic acid, alkenyl succinic acid ester, polyvalent alcohol ester, petroleum sulfonate, and dinonyl naphthalene sulfonate. As a corrosion inhibitor, there may be benzotriazole compounds, tolyltriazole compounds, and imidazole compounds. As a pour-point depressant, there may be a polymethacrylate polymer compatible with the lubricant base oil to be used, and so on. Examples of rubber swelling agent may be aromatic-type or ester-type rubber swelling agent. Examples of defoamant include silicones such as dimethyl silicone and fluoro silicone. Content of these additives is arbitrarily; normally, to the total mass of the composition, content of corrosion inhibitor is 0.005 to 0.2 mass %, defoamant content is 0.0005 to 0.01 mass %, and contents of other additives are respectively about 0.005 to 10 mass %.

Kinematic viscosity at 100 degree C. of the lubricating oil composition of the present invention is normally 2 to 25 $mm^2/s$, preferably 4 to 15 $mm^2/s$, more preferably 5 to 10 $mm^2/s$, and further more preferably 6.5 to 8 $mm^2/s$. In addition, viscosity index of the lubricating oil composition of the invention is normally 160 or more, preferably 180 or more, further more preferably 200 or more.

The lubricating oil composition for internal combustion engine of the invention is extremely excellent in high-temperature detergency so that it can attain retention of engine performance and life extension of the lubricating oil. Moreover, the lubricating oil composition for internal combustion engine of the invention also exhibits favorable hydrolytic stability; therefore it is possible to favorably retain the base number even under a condition where moisture is mixed and accumulated. Hence, the lubricating oil composition can be used for internal combustion engine of particularly a hybrid vehicle driven by electric motor and/or engine, specifically a hybrid vehicle having a parallel system or series-parallel system in which stop and operation of the engine are frequently repeated; it can also be used for internal combustion engine for marine vessel such as outboard motor and the like operated under a condition where moisture is hard to evaporate, gas engine in which a large amount of moisture tends to be mixed, or gasoline engine as well as diesel engine in which idling stop is controlled.

Further, the lubricating oil composition of the present invention can be used for applications other than internal combustion engine; the lubricating oil composition can also be preferably used for: automatic transmission, continuously variable transmission, or manual transmission for automobile, construction machines, agricultural machines, and so on; differential gear, industrial gear, turbine, and compressor.

EXAMPLES

Hereinafter, the present invention will be more specifically described by way of the following examples. However, the invention is not limited to these examples.

Table 1 shows properties of the lubricant base oils 1 to 3 used in the examples of the present invention. By using these lubricant base oils, eight types of lubricating oil compositions as seen from test sample Nos. 1 to 8 having the compositions shown in Table 2 were prepared. Ratio of the base oil was to a total amount of the base oil; additive amount of each additive was to a total amount of the composition. About these lubricating oil compositions, high-temperature detergency and hydrolytic stability were evaluated in accordance with the following evaluation method. The evaluation result is also shown in Table 2.

(1) High-Temperature Detergency Based on Hot Tube Test

In accordance with JPI-5S-55-99, Hot Tube Test was carried out. The rating was determined by giving ten points for clear and colorless (no lacquer) and zero point for opaque in black color. Then, the lubricating oil compositions were evaluated with reference to standard tubes prepared in advance showing transparency and color of point-by-point rating between the above ten to zero. If the rating at 290 degree C. is 6.0 or more, the oil was regarded as an excellent lubricating oil for normal gasoline engine and diesel engine. In the invention, due to the deterioration of the metallic detergent performance caused by hydrolytic activity, so as to retain high-temperature detergency over a long period of time, rating is particularly preferably 8.0 or more.

(2) Test for Hydrolytic Stability

Test for hydrolytic stability was carried out in accordance with ASTM D 2619, base number (hydrochloric acid method) was determined about the tested oil. If the base number was 4.0 mg KOH/g or more after the Test for hydrolytic stability, it could be said that it was practically sufficient base number; if it is 5.5 mgKOH/g or more, it can be said that it is particularly excellent.

TABLE 1

| | | Base oil | | |
|---|---|---|---|---|
| | | Base oil 1 | Base oil 2 | Base oil 3 |
| Basic ingredient | | Vacuum-distilled oil[1)] | Vacuum-distilled oil[1)] | Vacuum-distilled oil[2)] |
| Refining process | | Hydrocracking[3)] | Hydrocracking[3)] | Solvent refining[4)] |
| Dewaxing process | | Hydroisomerization[5)] | solvent dewaxing[6)] | solvent dewaxing[6)] |
| Kinematic viscosity (100° C.) | $mm^2/s$ | 4.3 | 4.1 | 4.4 |
| Kinematic viscosity (40° C.) | $mm^2/s$ | 20 | 19 | 23 |
| Viscosity index | | 123 | 120 | 100 |
| Pour-point | ° C. | −17.5 | −22.5 | −15.0 |
| Aniline point | ° C. | 116 | 112 | 99 |
| Iodine number | | 0.05 | 0.8 | 3.8 |
| Sulfur content | mass ppm | <1 | 2 | 1300 |
| Nitrogen content | mass ppm | <3 | <3 | 6 |
| NOACK volatility | mass % | 14 | 17 | 21 |
| EI-MS analysis (according to ASTM D 2786-91) | mass % | 54 | 53 | 34 |
| Paraffin and Naphthene contents in saturated molecule | | | | |
| Paraffin content | | | | |
| Naphthene content (mono-to hexa-cyclic) | mass % | 46 | 47 | 66 |
| Content of Monocyclic naphthene | mass % | 20 | 17 | 16 |
| Content of bi-to hexa-cyclic naphthene | mass % | 26 | 30 | 50 |
| (Paraffin) + (Monocyclic naphthene) | mass % | 74 | 70 | 50 |
| (Paraffin)/(Monocyclic naphthene) | | 2.7 | 3.1 | 2.1 |
| % $C_P$ | | 81 | 78 | 66 |
| % $C_N$ | | 19 | 21 | 29 |
| % $C_A$ | | 0 | 1 | 5 |
| % $C_P$/% $C_N$ | | 4.2 | 3.8 | 2.3 |

TABLE 1-continued

| | Base oil | | |
|---|---|---|---|
| | Base oil 1 | Base oil 2 | Base oil 3 |
| $^{13}$C-NMR analysis | 100 | 100 | 100 |
| Integral intensity attributed to total Carbon atom[7)] | | | |
| Integral intensity attributed to tertiary Carbon atom[8)] | 8.0 | 6.9 | 6.1 |
| Average carbon number | 29 | 29 | 27 |

[1)]A hydrocracked material obtained by treating topped crude bottom by vacuume distillation and desulfration thereafter.

[2)]A material obtained by treating topped crude bottom by vacuum distillation.

[3)]A step for hydrocracking aromatic components, nitrogen compounds, sulfur compounds, and etc. by using catalyst holding metal mainly containing VIII-group element transition metal.

[4)]A process including solvent refining by using solvent like furfural and further including hydrorefining.

[5)]Dewaxing process withr cracking a part of wax component and hydroisomerizing thereof.

[6)]Solvent dewaxing by using solvent like MEK.

[7)]A total of Integral intensity in region of 0-50 ppm.

[8)]A total of Integral intensity in region of 27.9-28.1 ppm, 28.4-28.6 ppm, 32.6-33.2 ppm, 34.4-34.6 ppm, 37.4-37.6 ppm, 38.8-39.1 ppm, and 40.4-40.6 ppm.

TABLE 2

| | | | Sample No. 1 | Sample No. 2 | Sample No. 3 | Sample No. 4 | Sample No. 5 | Sample No. 6 | Sample No. 7 | Sample No. 8 |
|---|---|---|---|---|---|---|---|---|---|---|
| Base oil (to total mass of Base oil) | Base oil 1 | mass % | 100 | | 100 | 100 | 100 | 100 | 100 | |
| | Base oil 2 | mass % | | 100 | | | | | | |
| | Base oil 3 | mass % | | | | | | | | 100 |
| Additives (to total mass of compositions) | | | | | | | | | | |
| (B) | (B1) Ca salicylate | mass % | 3.3 | 3.3 | 3.3 | | | 3.3 | 3.3 | 3.3 |
| | (B2) Ca sulfonate | mass % | | | | 1.6 | | | | |
| | (B3) Ca phenate | mass % | | | | | 3.0 | | | |
| (C) | (C1) Succinimide 1 | mass % | 4 | 4 | 4 | 4 | 4 | 7 | 0 | 4 |
| | (C2) Succinimide 2 | mass % | 3 | 3 | 3 | 3 | 3 | 0 | 7 | 3 |
| (D) | ZDTP | mass % | 1.2 | 1.2 | | 1.2 | 1.2 | 1.2 | 1.2 | 1.2 |
| | ZP | mass % | | | 1.4 | | | | | |
| Other additives | | mass % | 5.2 | 5.2 | 5.2 | 5.2 | 5.2 | 5.2 | 5.2 | 5.2 |
| | Base number (HCl method) | mgKOH/g | 6.48 | 6.48 | 6.07 | 6.54 | 6.41 | 6.43 | 6.52 | 6.45 |
| | Ca content in (B) | mass % | 0.20 | 0.20 | 0.20 | 0.20 | 0.20 | 0.20 | 0.20 | 0.20 |
| | B content in (C1) | mass % | 0.02 | 0.02 | 0.02 | 0.02 | 0.02 | 0.04 | 0.00 | 0.02 |
| | N content in (C) | mass % | 0.12 | 0.12 | 0.12 | 0.12 | 0.12 | 0.11 | 0.14 | 0.12 |
| | B/N ratio of (C) | | 0.17 | 0.17 | 0.17 | 0.17 | 0.17 | 0.33 | 0.00 | 0.17 |
| | P content in (D) | mass % | 0.07 | 0.07 | 0.07 | 0.07 | 0.07 | 0.07 | 0.07 | 0.07 |
| Results of the Performance evaluation | | | | | | | | | | |
| High-temperature detergency of New oil: HTT (290° C. × 16 hrs) | | Rating | 9.0 | 8.0 | 10.0 | 8.0 | 8.0 | 9.0 | 6.0 | 6.0 |
| Base number (HCl method) of Oil after Test for hydrolytic stability | | mgKOH/g | 5.98 | 5.73 | 5.88 | 5.01 | 4.83 | 4.04 | 6.22 | 5.62 |

Ca salicylate: Ca salt of Alkylsalicylic acid having Secondary $C_{14}$-$C_{18}$ alkyl overbased with Ca carbonate (Base number: 170 mgKOH/g, 6 mass %) (Composition of Alkylsalicylic acid Ca salt: 3-alkyl: 53 mol %, 4-alkyl: 4 mol %, 5-alkyl: 35 mol %, 3,5-dialkyl: 8 mol %)

Ca sulfonate: Ca carbonate overbased salt (Base number: 300 mgKOH/g, Ca: 12.0 mass %) of Alkylbenzene sulfonic acid Ca salt.

Ca phenate: Ca carbonate overbased salt (Base number: 200 mgKOH/g, Ca: 6.7 mass %) of Alkylphenol sulfide Ca salt.

Succinimide 1: Boric acid-modified polybutenyl succinimide, Mn of polybutenyl: 1300, N content: 1.5 mass %, B content: 0.5 mass %.

Succinimide 2: Polybutenyl succinimide, Mn of polybutenyl: 1000, N content: 2.0 mass %, B content: 0 mass %.

ZDTP: Zinc dithiophosphate (sec-$C_4$, $C_6$ZDTP, P content: 6.2%, S content: 14.9%)

ZP: Zinc dialkylphosphate ($C_8$ZP, P content: 5.0%)

Other additives: Aminic antioxidant (0.7 mass %), Viscosity index improver (4.5 mass %), Defoamant (20 mass ppm)

As clearly seen from Table 2, the lubricating oil compositions of test sample Nos. 1 to 6 of the present invention not only exhibit high detergency at high-temperature when being a new oil, but also retain practically sufficient base number even after the Test for hydrolytic stability. Especially, the compositions of test sample Nos. 1, 3, and 6 when being a new oil exhibit extremely excellent high-temperature detergency. Moreover, in the compositions of test sample Nos. 1 to 3, the base number after Test for hydrolytic stability is specifically high so that it is understood that these lubricating oil compositions can retain metallic detergent performance for a long period of time even under a condition where moisture is mixed.

By using lubricant base oils 1 to 3 of Table 1, eight types of lubricating oil compositions as seen from test sample Nos. 9 to 16 having the compositions shown in Table 3 were prepared. Ratio of the base oil was to a total amount of the base oil; additive amount of each additive was to a total amount of the composition. About these lubricating oil compositions, high-temperature detergency and hydrolytic stability were evaluated in accordance with the above evaluation methods. In addition, decreasing rate of the base number to the base number of new oil was measured. The evaluation result is also shown in Table 3.

TABLE 3

| | | | Sample No. 9 | Sample No. 10 | Sample No. 11 | Sample No. 12 | Sample No. 13 | Sample No. 14 | Sample No. 15 | Sample No. 16 |
|---|---|---|---|---|---|---|---|---|---|---|
| Base oil | Base oil 1 | mass % | 100 | 100 | 100 | | | 100 | 100 | 100 |
| (to total mass of | Base oil 2 | mass % | | | | 100 | | | | |
| Base oil) | Base oil 3 | mass % | | | | | 100 | | | |
| Additives (to total mass of compositions) | | | | | | | | | | |
| (B) | (B1) Ca salicylate | mass % | 3.3 | 3.3 | 3.3 | 3.3 | 3.3 | 3.3 | | |
| | (B2) Ca sulfonate | mass % | | | | | | | 1.6 | |
| | (B3) Ca phenate | mass % | | | | | | | | 3.0 |
| (C) | (C1) Succinimide 1 | mass % | 0 | 4 | 4 | 4 | 4 | 7 | 4 | 4 |
| | (C2) Succinimide 2 | mass % | 7 | 3 | 3 | 3 | 3 | 0 | 3 | 3 |
| (D) | ZDTP | mass % | 1.2 | 1.2 | | 1.2 | 1.2 | 1.2 | 1.2 | 1.2 |
| | ZP | mass % | | | 1.4 | | | | | |
| Other additives | | mass % | 5.2 | 5.2 | 5.2 | 5.2 | 5.2 | 5.2 | 5.2 | 5.2 |
| | Base number (HCl method) | mgKOH/g | 6.52 | 6.48 | 6.07 | 6.48 | 6.45 | 6.43 | 6.54 | 6.41 |
| | Ca content in (B) | mass % | 0.20 | 0.20 | 0.20 | 0.20 | 0.20 | 0.20 | 0.20 | 0.20 |
| | B content in (C1) | mass % | 0.00 | 0.02 | 0.02 | 0.02 | 0.02 | 0.04 | 0.02 | 0.02 |
| | N content in (C2) | mass % | 0.14 | 0.06 | 0.06 | 0.06 | 0.06 | 0.00 | 0.06 | 0.06 |
| | N content in (C) | mass % | 0.14 | 0.12 | 0.12 | 0.12 | 0.12 | 0.11 | 0.12 | 0.12 |
| | B/N ratio of (C) | | 0.00 | 0.17 | 0.17 | 0.17 | 0.17 | 0.33 | 0.17 | 0.17 |
| | P content in (D) | mass % | 0.07 | 0.07 | 0.07 | 0.07 | 0.07 | 0.07 | 0.07 | 0.07 |
| Results of the Performance evaluation | | | | | | | | | | |
| Base number (HCl method) of Oil after Test for hydrolytic stability | | mgKOH/g | 6.22 | 5.98 | 5.88 | 5.73 | 5.62 | 4.04 | 5.01 | 4.83 |
| Decreasing rate of Base number of Oil after Test for hydrolytic stability | | % | 4.6 | 7.7 | 3.1 | 11.6 | 12.9 | 37.2 | 23.4 | 24.6 |
| High-temperature detergency of New oil: HTT (290° C. × 16 hrs) | | Rating | 6.0 | 9.0 | 10.0 | 8.0 | 6.0 | 9.0 | 8.0 | 8.0 |

Ca salicylate: Ca salt of Alkylsalicylic acid having Secondary C14-C18 alkyl overbased with Ca carbonate (Base number: 170 mgKOH/g, 6 mass %) (Composition of Alkylsalicylic acid Ca salt: 3-alkyl: 53 mol %, 4-alkyl: 4 mol %, 5-alkyl: 35 mol %, 3,5-dialkyl: 8 mol %)
Ca sulfonate: Ca carbonate overbased salt (Base number: 300 mgKOH/g, Ca: 12.0 mass %) of Alkylbenzene sulfonic acid Ca salt.
Ca phenate: Ca carbonate overbased salt (Base number: 200 mgKOH/g, Ca: 6.7 mass %) of Alkylphenol sulfide Ca salt.
Succinimide 1: Boric acid-modified polybutenyl succinimide, Mn of polybutenyl: 1300, N content: 1.5 mass %, B content: 0.5 mass %.
Succinimide 2: Polybutenyl succinimide, Mn of polybutenyl: 1000, N content: 2.0 mass %, B content: 0 mass %.
ZDTP: Zinc dithiophosphate (sec-$C_4$, $C_6$ZDTP, P content: 6.2%, S content: 14.9%)
ZP: Zinc dialkylphosphate ($C_8$ZP, P content: 5.0%)
Other additives: Aminic antioxidant (0.7 mass %), Viscosity index improver (4.5 mass %), Defoamant (20 mass ppm)

As clearly seen from Table 3, the lubricating oil compositions of test sample Nos. 9 to 13 of the invention exhibit high detergency at high-temperature when being a new oil, but also decreasing rate of the base number after Test for hydrolytic stability is significantly low so that it is understood that these lubricating oil compositions can retain metallic detergent performance for a long period of time even under a condition where moisture is mixed. Particularly the lubricating oil composition of test sample Nos. 10 to 12, among them, test sample Nos. 10 and 11 show excellent results for both Test for hydrolytic stability and high-temperature detergency.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that lubricating oil composition for internal combustion engine with such an alternation are included in the technical scope of the invention.

The invention claimed is:

1. A lubricating oil composition for internal combustion engine, which comprises:

(A1) a lubricant base oil as a main component characterized by kinematic viscosity at 100 degree C. being 1 to 8 $mm^2/s$, aniline point being 100 degree C. or more, paraffinic content in saturates being between about 40% and 70 mass %, monocyclic naphthenic content in saturates being 25 mass % or less, bicyclic to hexacyclic naphthenic content in saturates being 35 mass % or less, iodine number being 2 or less, and ratio of tertiary carbon to the total carbon atoms composing the (A1) being 6.3% or more;

and which further comprises, to the total mass of the composition:

(B) 0.16 to 0.5 mass % of a metallic detergent as metal content;

(C1) 0.005 to 0.2 mass % of a boron-containing succinimide ashless dispersant as boron content.

2. The lubricating oil composition for internal combustion engine according to claim 1, wherein ratio of tertiary carbon to the total carbon atoms composing the (A1) component is 7.2% or more.

3. The lubricating oil composition for internal combustion engine according to claim 1, wherein iodine number of the (A1) component is 0.5 or less.

4. The lubricating oil composition for internal combustion engine according to claim 1, wherein the (B) component is (B1) a metal salt and/or basic (overbased) salt of alkylsalicylic acid containing a dialkylsalicylic acid.

5. The lubricating oil composition for internal combustion engine according to claim 1, wherein content of the (C1) component to the total mass of the composition is 0.005 to 0.03 mass % as boron content.

6. The lubricating oil composition for internal combustion engine according to claim 1, which further comprises 0.005 to 0.2 mass % of (C2) a boron-free succinimide ashless dispersant as nitrogen content, wherein mass ratio (B/N ratio) of boron content attributed to the (C1) component to a total nitrogen content attributed to the (C1) component and the (C2) component is 0.05 to 0.3.

7. A lubricating oil composition for internal combustion engine of hybrid vehicle, which comprises:

(A1) a lubricant base oil characterized by kinematic viscosity at 100 degree C. being 1 to 8 $mm^2/s$, aniline point being 100 degree C. or more, paraffinic content in saturates being between about 40% and 70 mass %, monocyclic naphthenic content in saturates being 25 mass % or less, bicyclic to hexacyclic naphthenic content in saturates being 35 mass % or less, iodine number being 2 or less, and ratio of tertiary carbon to the total carbon atoms composing the (A1) being 6.3% or more, and which further comprises, to the total mass of the composition:

(B') 0.16 to 0.5 mass % of a salicylate detergent as metal content; and (C2) 0.005 to 0.4 mass % of a boron-free succinimide ashless dispersant as nitrogen content.

8. A lubricating oil composition for internal combustion engine of hybrid vehicle according to claim 7, further comprising:

(C1) 0.001 to 0.03 mass % of a boron-containing succinimide ashless dispersant as boron content.

9. The lubricating oil composition for internal combustion engine according to claim 8, wherein mass ratio (B/N ratio) of boron content attributed to the (C1) component to a total nitrogen content attributed to the (C1) component and the (C2) component is 0.05 to 0.3.

10. The lubricating oil composition for internal combustion engine according to claim 7, wherein the (B') component is (B1) a metal salt and/or basic (overbased) salt of alkylsalicylic acid containing a dialkylsalicylic acid.

11. The lubricating oil composition for internal combustion engine according to claim 8, wherein the (B') component is (B1) a metal salt and/or basic (overbased) salt of alkylsalicylic acid containing a dialkylsalicylic acid.

12. The lubricating oil composition for internal combustion engine according to claim 1, further comprising:

(D) 0.005 to 0.2 mass % of a metal salt of phosphorus-containing acid as phosphorus content to the total mass of the composition, wherein the pour point of the component (A1) is −15° C. or less the paraffinic content in saturates in the component (A1) is 40 mass % or more and 70 mass % or less.

13. The lubricating oil composition for internal combustion engine according to claim 12, wherein the paraffinic content in saturates in the component (A1) is 40 mass % or more and 65 mass % or less.

14. The lubricating oil composition for internal combustion engine according to claim 1, wherein the bicyclic to hexacyclic naphthenic content in saturates in the component (A1) is 10 mass % or more and 35 mass % or less.

15. The lubricating oil composition for internal combustion engine according to claim 7, further comprising:

(D) 0.005 to 0.2 mass % of a metal salt of phosphorus-containing acid as phosphorus content to the total mass of the composition, wherein the pour point of the component (A1) is −15° C. or less; and the paraffinic content in saturates in the component (A1) is 40 mass % or more and 70 mass % or less.

16. The lubricating oil composition for internal combustion engine according to claim 15, wherein the paraffinic content in saturates in the component (A1) is 65 mass % or less.

17. The lubricating oil composition for internal combustion engine according to claim 7, wherein the bicyclic to hexacyclic naphthenic content in saturates in the component (A1) is 10 mass % or more.

18. A lubricating oil composition for internal combustion engine, which comprises:

(A1) a lubricant base oil as a main component characterized by kinematic viscosity at 100 degree C. being 1 to 8 $mm^2/s$, aniline point being 100 degree C. or more, monocyclic naphthenic content in saturates being 25 mass % or less, bicyclic to hexacyclic naphthenic content in saturates being 10 mass % or more and 35 mass % or less, iodine number being 2 or less, and ratio of tertiary carbon to the total carbon atoms composing the (A1) being 6.3% or more;

and which further comprises, to the total mass of the composition:

(B) 0.16 to 0.5 mass % of a metallic detergent as metal content; and (C1) 0.005 to 0.2 mass % of a boron-containing succinimide ashless dispersant as boron content, wherein the paraffinic content in saturates in the component (A1) is 40 mass % or more.

19. A lubricating base oil composition for internal combustion engine of hybrid vehicle, which comprises:

(A1) a lubricant base oil characterized by kinematic viscosity at 100 degree C. being 1 to 8 $mm^2/s$, aniline point being 100 degree C. or more, monocyclic naphthenic content in saturates being 25 mass % or less, bicyclic to hexacyclic naphthenic content in saturates being 10 mass % or more and 35 mass % or less, iodine number being 2 or less, and ratio of tertiary carbon to the total carbon atoms composing the (A1) being 6.3% or more, and which further comprises, to the total mass of the composition:

(B') 0.16 to 0.5 mass % of a salicylate detergent as metal content; and (C2) 0.005 to 0.4 mass % of a boron-free succinimide ashless dispersant as nitrogen content, wherein the paraffinic content in saturates in the component (A1) is 40 mass % or more.

20. The lubricating oil composition for internal combustion engine according to claim 18, further comprising:

(D) 0.005 to 0.2 mass % of a metal salt of phosphorus-containing acid as phosphorus content to the total mass of the composition, wherein the pour point of the component (A1) is −15° C. or less; and the paraffinic content in saturates in the component (A1) is 40 mass % or more.

21. The lubricating oil composition for internal combustion engine according to claim 19, further comprising:

(D) 0.005 to 0.2 mass % of a metal salt of phosphorus-containing acid as phosphorus content to the total mass of the composition, wherein the pour point of the component (A1) is −15° C. or less; and the paraffinic content in saturates in the component (A1) is 40 mass % or more.

* * * * *